US006050617A

United States Patent [19]

Prevot et al.

[11] Patent Number: 6,050,617

[45] **Date of Patent: *Apr. 18, 2000**

[54] LOCK FOR SLIDING DOOR, WINDOW OR LIKE CLOSURE

[75] Inventors: Gérard Prevot, Willerwald; Gérard Desplantes, Sarrebourg; Eric Alvarez, Hommert, all of France

[73] Assignee: Ferco International Ferrures et Serrures de Batiment, Reding, France

[ * ] Notice: This patent is subject to a terminal disclaimer.

[21] Appl. No.: 09/054,772

[22] Filed: Apr. 3, 1998

[30] Foreign Application Priority Data

Apr. 3, 1997 [FR] France ..... 97 04064
Jun. 25, 1997 [FR] France ..... 97 07934

[51] Int. Cl.[7] ..... E05C 1/06

[52] U.S. Cl. ..... 292/140; 292/107; 292/DIG. 46; 70/95

[58] Field of Search ..... 292/140, 98, 107, 292/170, 187, DIG. 31, DIG. 46, DIG. 38, 100, 165, 152, DIG. 24, DIG. 30, DIG. 37, DIG. 63; 70/95, 99, 69, 70

[56] References Cited

U.S. PATENT DOCUMENTS

| | | | |
|---|---|---|---|
| 2,789,852 | 4/1957 | Eads | 292/110 |
| 2,990,208 | 6/1961 | Miller | 292/165 |
| 3,120,748 | 2/1964 | Rechberg | 292/DIG. 46 |
| 3,353,855 | 11/1967 | Smith | 70/95 |
| 3,390,557 | 7/1968 | Ericksson et al. | 292/140 |
| 3,904,229 | 9/1975 | Waldo | 292/29 |
| 4,024,739 | 5/1977 | Kaufman | 70/97 |
| 4,103,946 | 8/1978 | Tipler | 292/114 |
| 4,754,624 | 7/1988 | Flemming et al. | 70/95 |
| 4,790,157 | 12/1988 | Lin | 70/95 |
| 4,912,950 | 4/1990 | Crowle | 70/58 |
| 5,125,703 | 6/1992 | Clancy et al. | 292/337 |
| 5,145,221 | 9/1992 | Pennebaker et al. | 292/175 |
| 5,158,329 | 10/1992 | Schlack | 292/87 |
| 5,201,557 | 4/1993 | Schlack | 292/161 |
| 5,561,994 | 10/1996 | Smith et al. | 70/99 |

FOREIGN PATENT DOCUMENTS

| | | |
|---|---|---|
| 0 044 264 | 1/1982 | European Pat. Off. . |
| 0 345 185 | 12/1989 | European Pat. Off. . |
| 2700577 | 7/1994 | France . |
| 2115063 | 9/1983 | United Kingdom . |

*Primary Examiner*—Flemming Saether
*Assistant Examiner*—Clifford B. Vaterlaus
*Attorney, Agent, or Firm*—Kenyon & Kenyon

[57] ABSTRACT

A lock for sliding door, window or like closure includes a drive member mobile in the longitudinal direction of the casing relative to the casing and includes an arrangement which cooperates with a complementary arrangement attached to the cylinder to enable the drive member to be moved in one direction or the other by means of the key and another arrangement which cooperates with a complementary arrangement of the sliding assembly to enable the sliding assembly to be moved by means of the key.

12 Claims, 7 Drawing Sheets

LOCK FOR SLIDING DOOR, WINDOW OR LIKE CLOSURE

BACKGROUND OF THE INVENTION

1. Field of the invention

The present invention concerns a lock for sliding door, window or like closures including a sliding assembly mobile in the longitudinal direction of a casing and carrying a bolt, a maneuvering member for actuating the sliding assembly from the inside wall of the closure and means for actuating the sliding assembly from the covering plate of the closure by means of a lock cylinder operated by a key.

2. Description of the prior art

A lock of the above type is described in FR-A-2 582 710.

The above lock is relatively bulky and costly.

The aim of the present invention is to remedy the drawbacks of prior art locks of the above type and to propose a lock of this type that has a simple and economic structure, is extremely reliable and can easily be adapted to enable in situ adjustment, on the installation site of the position of the lock according to that of the closure relative to the frame, as with the bolt.

SUMMARY OF THE INVENTION

In accordance with the present invention a lock of the above type includes a drive member mobile in the longitudinal direction of the casing relative to the casing and including means adapted to cooperate with complementary means attached to the cylinder to enable the drive member to be moved one way or the other by the key and means adapted to cooperate with complementary means of the sliding assembly to enable the sliding assembly to be moved one way or the other by the key.

Other features and advantages of the invention will become apparent in the following detailed description given by way of non-limiting example only with reference to the appended drawings:

DETAILED DESCRIPTION OF THE PREFERRED EMBODIMENTS

Figure 1:
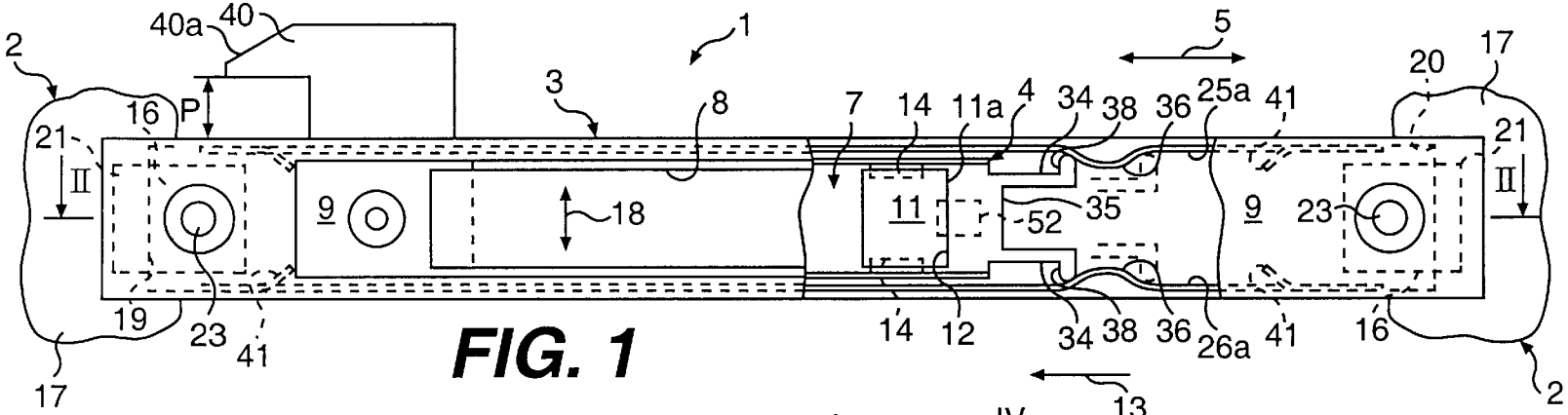
FIG. 1 is a cut away front view of one embodiment of a lock in accordance with the present invention showing the slider in its locked position.

In the embodiment shown in FIGS. 1 through 6 the lock 1 for a sliding door, window or like closure 2 comprises, inside a casing 3, a slider 4 mobile in the longitudinal direction 5 of the casing 3 and carrying a bolt-carrier 6, means for immobilizing the slider 4 relative to the casing 3 in the locked position of said slider 4 and means for releasing the slider 4 from its locked position. The slider 4 includes maneuvering member means 7 accessible through a longitudinal slot 8 in the covering plate 9 of the casing 3.

The slider 4 has on its face 10 adjacent the covering plate 9 of the casing 3 a projecting member 11 having a predetermined height C relative to said adjacent face 10. The projecting member 11 is adapted to project through the slot 8 in the locked position of the slider 4 and abuts against the edge surface 12 of the covering plate 9 that defines the longitudinal end of the slot 8 that is the rear end in terms of the locking direction 13 of the slider (see FIG. 2).

Figure 2:
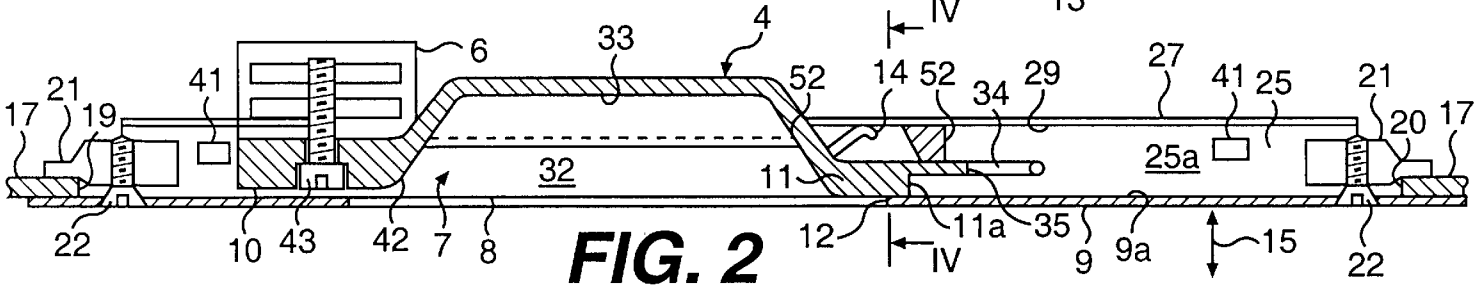
FIG. 2 is a view in section taken along the line II—II in FIG. 1 showing the slider in its locked position.

To be more precise, one end of the projecting member 11, facing the opposite way to the locking direction 13, is an edge surface 11*a* that engages with the edge surface 12 in the locked position of the slider 4 (see FIG. 2). The projecting member 11 therefore constitutes an anti-break-in device and immobilizes the slider 4 in its locked position.

Return spring means that include, for example, a pair of lateral lugs 14 are disposed the slider 4 and the casing 3 to spring-load the slider 4 towards the covering plate 9 of the casing 3 but allow the slider 4 to move in the direction 15 perpendicular to the covering plate 9 a distance at least equal to said predetermined height C. This enables the projecting member 11 to be pushed inside the casing 3 to release the slider 4 from its locked position, the projecting member 11 then sliding along the inside face 9*a* of the covering plate 9 of the casing 3. The distance C is substantially equal to the thickness of the covering plate 9, for example. This releases the projecting member 11.

In the conventional way, and as shown diagrammatically in FIGS. 1 through 4, the casing 3 is introduced into a slot 16 in the inside wall 17 of the sliding closure 2.

The sliding closure 2 is a conventional closure comprising frames made from aluminum or other material extrusions.

The covering plate 9 of the casing 3 covers the opening 16 entirely. The casing 3 is fixed to the inside wall 17 of the closure in a conventional way: each transverse edge 19, 20 of the opening 16 is gripped between the covering plate 9 of the casing 3 and a fixing member 21 by means of a fixing screw 22 introduced from the outside of the casing 3 into a hole 23 in the covering plate 9 (see FIGS. 1 to 3).

Figure 4:
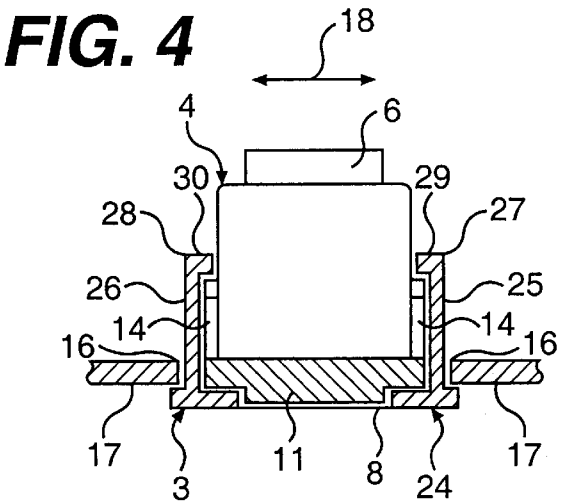
FIG. 4 is a diagrammatic view in section taken along the line IV—IV in FIG. 2.

In the present example, and as shown in detail in FIG. 4, the casing 3 comprises an extrusion 24 having two substantially parallel lateral longitudinal walls 25, 26 projecting from the same side of the covering plate 9. Each lateral longitudinal wall 25, 26 has on its longitudinal edge 27, 28 opposite the covering plate 9 a longitudinal rim 29, 30 extending transversely towards the other lateral wall 26, 25.

The longitudinal rims 29, 30 extend transversely over at least part of the transverse dimension of the casing and can merge to form a solid wall forming a back wall of the casing 3.

As shown in the figures, the slider 4 has two lateral lugs 14 each adapted to bear elastically on the corresponding rim 29, 30 of the casing 3.

The lugs 14 are made in any manner known in itself. They can be fixed to the slider 4 in any manner, for example by welding or brazing. They can equally be cast in one piece with the slider 4.

In the example shown the slider 4 has in its middle part maneuvering member means 7 consisting of a recess 32 the concave side of which faces the slot 8 in the covering plate 9 of the casing 3.

The recess 32 can be formed by molding or by bending, for example. It provides a passage for the user to insert their fingers through the slot 8 to apply a longitudinal force to the bottom wall 33 of the recess 32 to move the slider 4 one way or the other in the longitudinal direction 5 of the casing and to apply a force in the direction 15 perpendicular to the covering plate 9 of the casing 3 to release the slider 4 from its locked position.

The slider 4 includes means adapted to cooperate with complementary means 36 that can include, for example, enlargements of the casing 3 to render the unlocked and locked positions of the slider 4 precise and stable. These means can include, for example, fingers 34. The means operate by elastically opposing with a predetermined force any displacement of the slider 4 either way in the longitudinal direction 5 from one or other of said stable positions, where applicable assisting the movement of the slider 4 to the opposite stable position in the event of passing beyond an unstable or substantially unstable middle position.

In this example the slider 4 has two fingers 34 projecting longitudinally from one end 35 of the slider 4. Each of the lateral longitudinal walls 25, 26 of the casing 3 has an enlargement 36 projecting towards the inside of the casing 3 relative to the wall 25, 26. Each enlargement 36 is arranged so that a feeler 38 at the free end of the corresponding finger 34 and projecting towards the corresponding wall 25, 26 of the casing 3 relative to the finger 34 is on a respective side of said enlargement 36 in the stable unlocked and locked positions of the slider 4, respectively.

On departing from either of the two stable positions of the fingers 34, i.e. the immobilized locked position shown in full line in FIG. 1 or the released position shown in dashed line in that figure, each enlargement 36 therefore constitutes a first ramp on passing over which the fingers 34 must retract elastically when the slider 4 moves from either of said stable positions to an unstable or substantially unstable middle position, then a second ramp on which the fingers 34 bear elastically when the slider 4 moves from this middle position to the opposite stable position.

The instability of the middle position is due to the presence of the enlargements 36 and to the elastic force exerted on the enlargements by the fingers 34.

The means just described oppose any unintentional movement of the slider 4 in the longitudinal direction.

As shown in FIG. 1 in particular the enlargements 36 are formed by deforming the lateral longitudinal walls 25, 26 of the casing 3 towards the inside of the casing 3, for example. This deformation is a plastic deformation and is easily obtained if the casing 3 is a light alloy or plastics material extrusion 24.

Abutment means 41 are formed on the inside face 25*a*, 26*a* of at least one lateral longitudinal wall 25, 26 of the casing 3 after the slider 4 is inserted in the casing 3 to limit the travel of the slider 4 at least one way inside the casing 3.

There is preferably an abutment 41 on each longitudinal wall 25, 26 of the casing 3 near each longitudinal end of said casing 3. The abutments are made in any manner known in itself, for example by punching a tongue directed towards the inside of the casing in each of the lateral longitudinal walls 25, 26 of the latter.

In the example shown, the slider 4 carries a bolt-carrier 6 near the end 42 of the maneuvering member 7 opposite the projecting member 11. The length L of the slot 8 (see FIG. 7) and the position of the bolt-carrier 6 are predetermined so that a screw 43 for immobilizing the projection P of the bolt 40 (see FIG. 1) is accessible via the slot 8 in the unlocked position of the slider 4 shown in FIG. 3.

Figure 7:
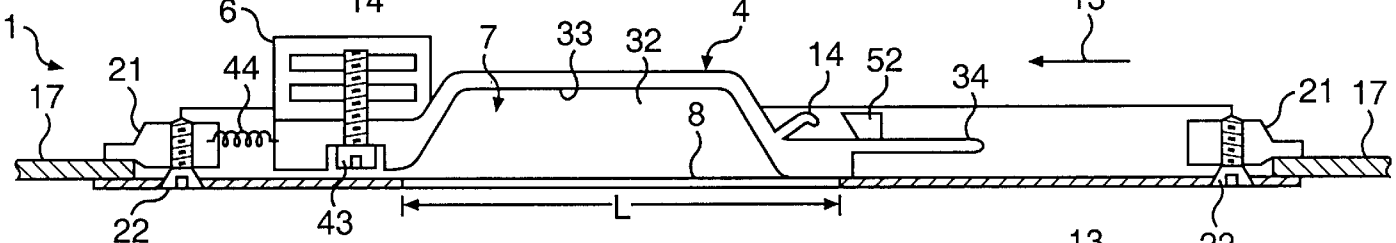
FIG. 7 is a diagrammatic view similar to FIG. 2 of another embodiment of the invention.
Figure 8:
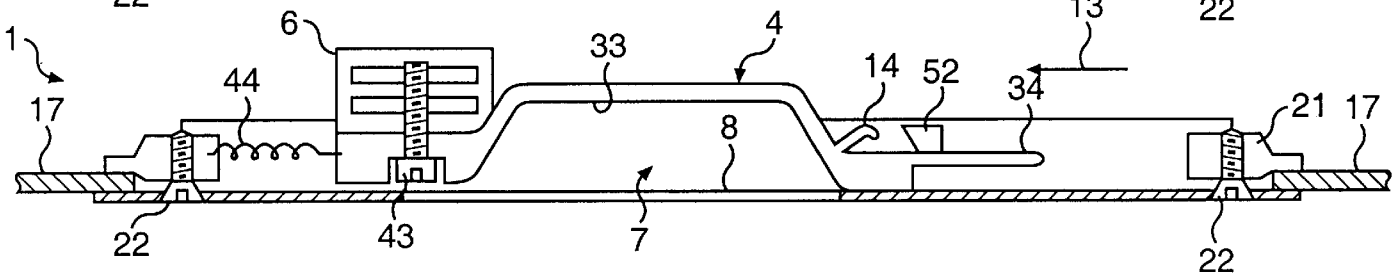
FIG. 8 is a diagrammatic view similar to FIG. 3 of the FIG. 7 embodiment.

In the embodiment of FIGS. 7 and 8 spring means 44 between the casing 3 and the slider 4 spring-load the slider 4 in the locking direction 13. Thus the slider 4 is moved automatically towards its locked position.

The movement of the slider 4 by the spring 44 can be stopped before it reaches the locked position, as shown in FIG. 7, to require manual intervention to reach the locked position and immobilize the slider 4 in that position.

In this way, if the closure is being closed, the chamfer 40*a* on the bolt 40 bearing on the striker (not shown) pushes the bolt 40 and the slider 4 in the unlocking direction against the action of the spring 44. The latter automatically returns the slider 4 and the bolt 40 to the position shown in FIG. 7, which is near but not the same as the immobilized locked position of FIGS. 1 and 2.

Indexing means of any kind (stamping, ramp cooperating with the finger 34, etc) are provided to stop the slider 4 in this position.

This operation is therefore possible without risk of damaging the striker and/or the bolt. However, manual maneuvering of the slider 4 is necessary to place the slider 4 in its locked position to obtain the anti-break-in effect of the present invention.

The spring 44 can equally be rated to return the slider 4 automatically to its locked position. In the absence of the anti-break-in device, the above remarks concerning the ability of the chamfer 40*a* on the bolt 40 to push the bolt 40 back in the event of misoperation remain valid.

In contrast, in the case of an automatic lock fitted with an anti-break-in device of the above type or of any other type adapted to immobilize the slider automatically in its locked position it is necessary to provide an anti-misoperation device of any type to sense the proximity of the frame and to release the slider before misoperation of the closure damages the striker and/or the bolt.

Figure 9:
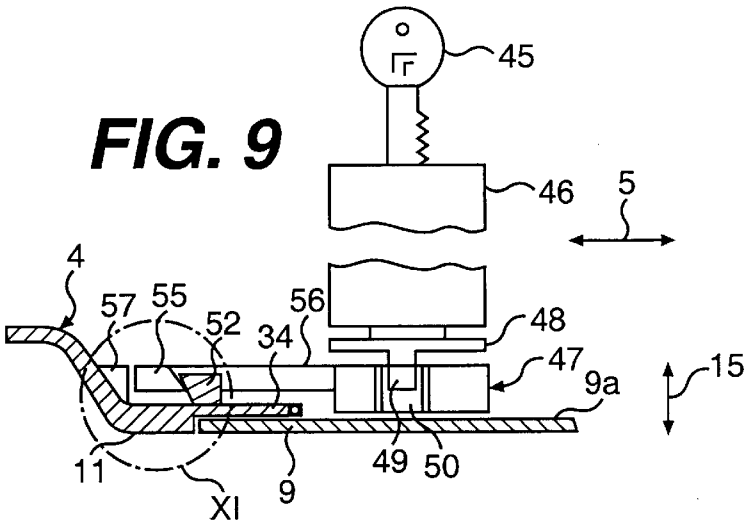
FIG. 9 is a view to a larger scale of part of FIG. 2 in a different embodiment of the present invention including a lock in the plane of the figure.
Figure 10:
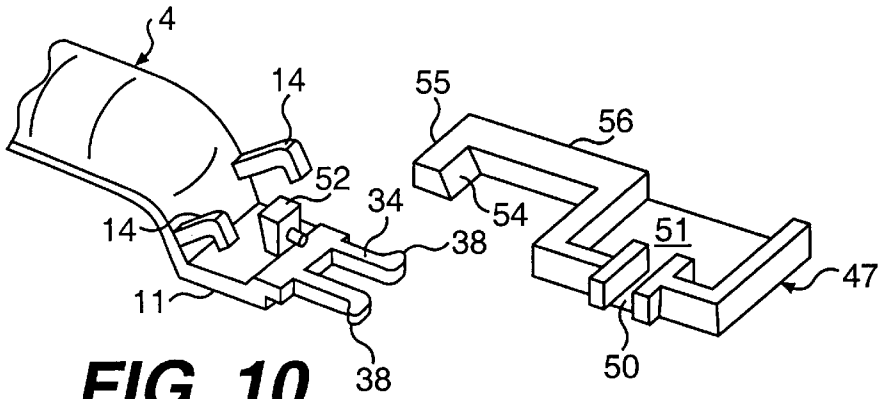
FIG. 10 is an exploded perspective view of the embodiment shown in FIG. 9.
Figure 11:
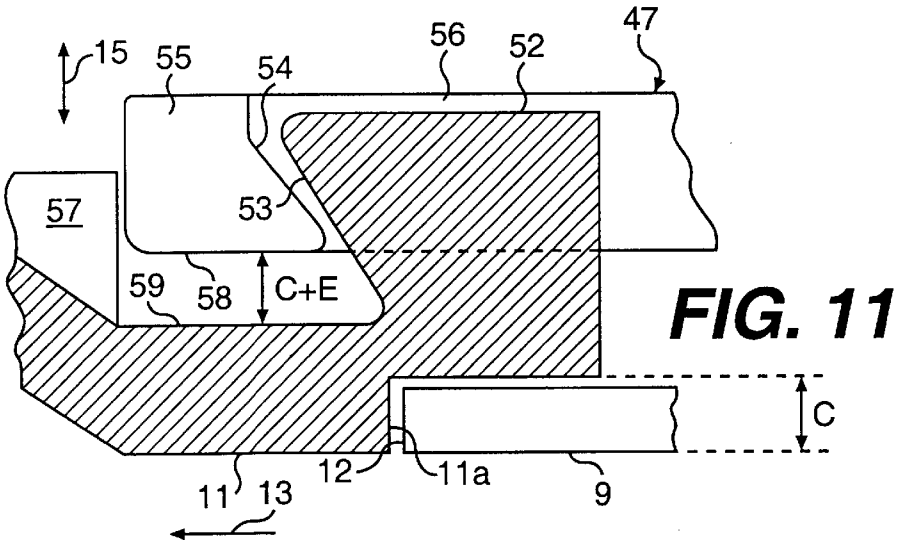
FIG. 11 is a view to a larger scale of the detail XI from FIG. 9.
Figure 6:
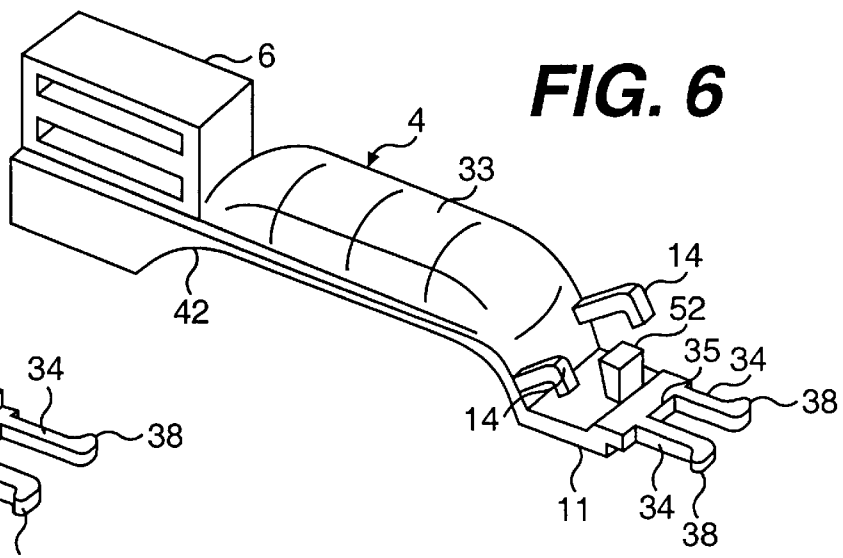
FIG. 6 is a view similar to FIG. 5 showing the maneuvering member directed in the opposite direction.

In the embodiment shown in FIGS. 9 through 11 the anti-break-in device formed by projecting member 11 can be released from outside the closure 2 by a key 45 operating a lock cylinder 46 operating a drive member 47 driving the slider 4. In this example the drive member 47 is adapted to slide along the inside face 9*a* of the covering plate 9.

In the example shown the cylinder 46 terminates axially in a disk 48 carrying a maneuvering finger 49 adapted to engage in a housing 50 in the drive member 47.

The drive member 47 has an opening 51 allowing the finger 49 to move on the axis of the housing 50 and on respective opposite sides of this axis parallel to the wall 9.

FIGS. 12A through 12D are diagrams showing the various positions of the finger 49 relative to the opening 51 during the various phases of an unlocking operation.

In the locked position (FIG. 12A) the drive member 47 has been moved in the locking direction 13, towards the left in the figure, and the finger 49 occupies the relative position 49a near the wall 51*a*, disengaged from the walls of the housing 50. The finger 49 in position 49*a* abuts against a wall element 80 parallel to the direction 5.

Figure 12D:
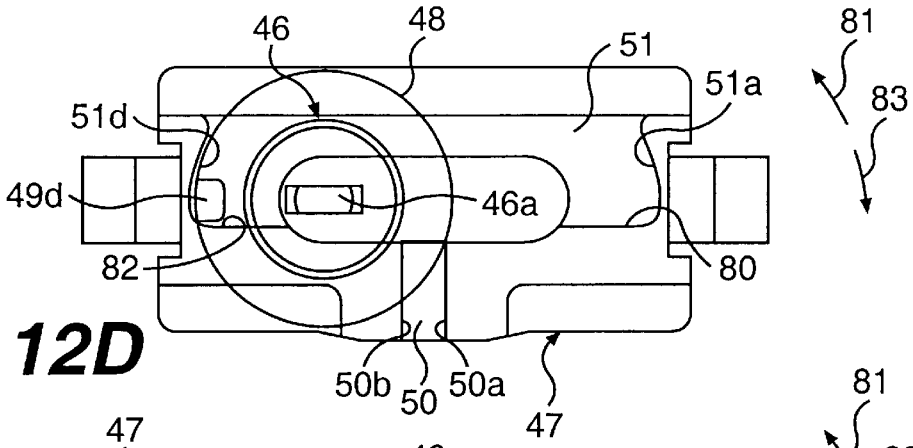
FIGS. 12A through 12D are top views to a larger scale of the drive member from the embodiment of FIGS. 9 through 11 showing the various phases of an unlocking operation in which the lock cylinder is respectively shown in its starting position (0°) and after rotating 205°, 335° and 540°.
Figure 12C:
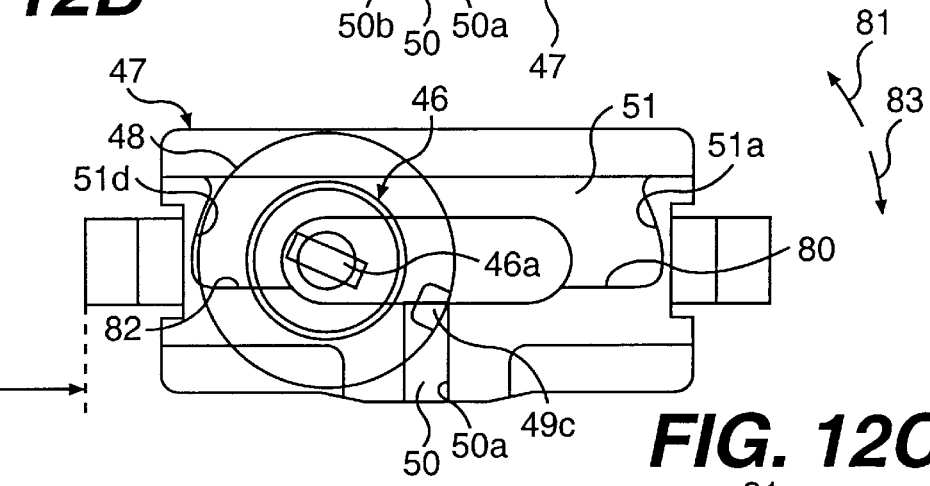
Figure 12B:
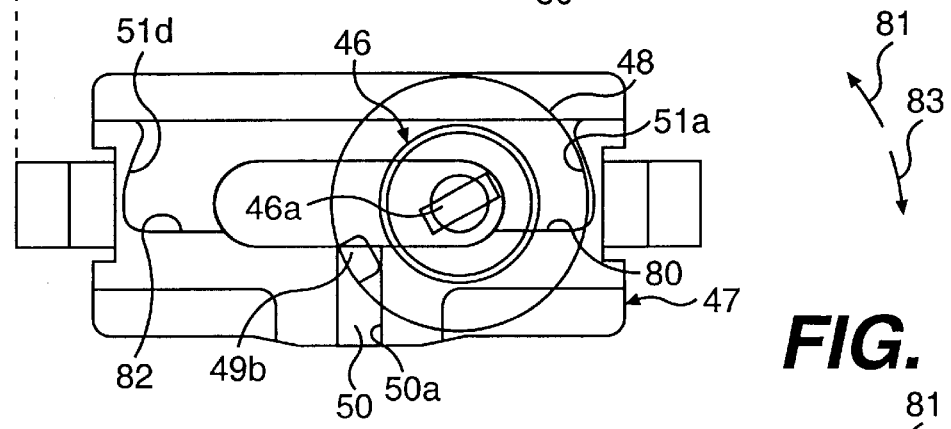

In the situation represented in FIG. 12B the cylinder 46 has turned 205° in the unlocking direction 81, which is the anticlockwise direction in the figure. The finger 49 in position 49*b* enters the housing 50 and abuts against the wall 50*a*. The drive member 47 has not yet moved.

Figure 3:
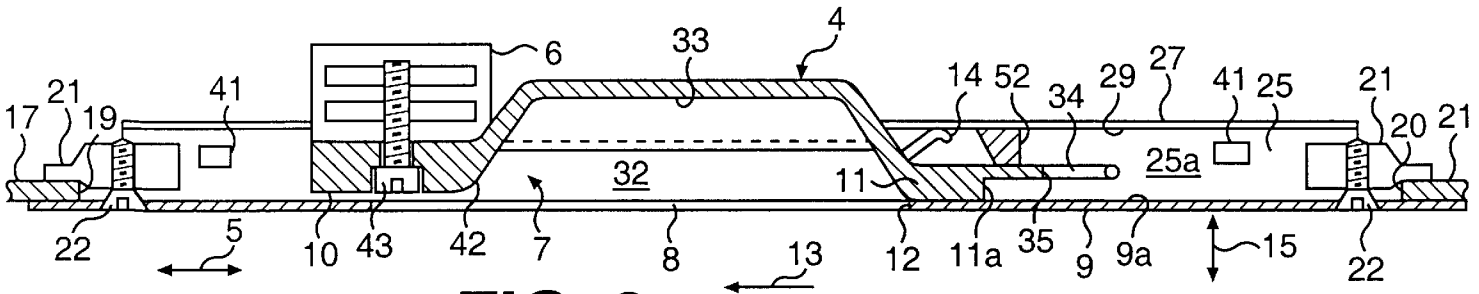
FIG. 3 is a view similar to FIG. 2 showing the slider in its unlocked position.
Figure 12A:
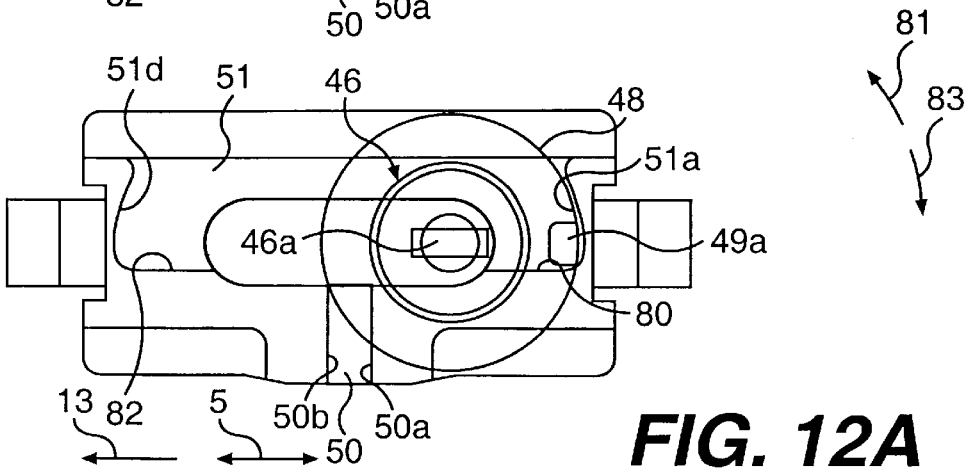

In the situation represented in FIG. 12C the cylinder 46 has turned a total of 335° in the direction 81 from the FIG. 12A position. During rotation from 205° to 335° the finger 49 has remained trapped in the housing 50 and has pushed the wall 50*a* towards the right in the figure to move the drive member 47 in the unlocking direction, i.e. in the direction opposite the locking direction 13, towards the right in the figure, a distance A equal to the sliding travel of the bolt 40 between its locked position (FIG. 2) and its unlocked position (FIG. 3). The finger 49 is at this time in position 49*c* in which it is disengaged from the wall 50*a*.

In the situation represented in FIG. 12D the cylinder 46 has turned a total of 540° and the finger 49 is in position 49*d* abutted against the wall 51*d* opposite the wall 51*a* and against the wall 82 extending the wall 80.

In this last phase the drive member 47 has remained in its unlocked position without moving.

Thus the slider 4 has been released manually by means of the cylinder 46 and has been moved to its unlocked position (there is no spring 44). The finger 49 has moved to the relative position 49*d*, near the wall 51*d*, disengaged from the walls of the housing 50, which corresponds to the unlocked position of the slider, and abuts against the wall 82 parallel to the direction 5.

For the reverse locking maneuver the cylinder 46 is turned in the opposite direction 83. The finger 49 leaves position 49*d* to move to position 49*c* in which the wall 50*a* allows it to enter the housing 50 where it abuts against the wall 50*b*. In rotating from 335° to 205° the finger 49 moves from position 49*c* to position 49*b* and pushes the wall 50*b* and the whole of the drive member 47 the same distance A in the locking direction 13, towards the left in the figure. In position 49*b* the finger 49 is disengaged from the wall 50*b*, leaves the housing 50 and can return freely to position 49*a*.

To enable release of the slider 4 from its locked position (FIG. 2) the drive member 47 and the slider 4 include complementary means of conjugate shape adapted to transform movement of the drive member 47 in the longitudinal direction 5 at the beginning of an unlocking operation into movement of the slider 4 in the direction 15 perpendicular to the covering plate 9 of the casing 3.

As shown in detail in FIG. 11 the slider 4 includes a stud 52 the transverse face 53 of which facing in the locking direction 13 of the slider 4 is inclined relative to said perpendicular direction 15 and extends in the locking direction 13 and towards the inside of the casing 3. The drive member 47 has a complementary face 54 inclined in substantially the same direction to move the slider 4 in the direction 15 towards the inside of the casing 3 at the start of an operation to unlock the slider 4 by means of the key 45.

The face 54 of the drive member 47 is part of a lever member 55 carried by an arm 56 of the drive member 47.

The lever 55 is held between the stud 52 and an abutment 57 of the slider 4 which means that the lever 55 must be inserted transversely relative to the slider 4.

The surface 58 of the lever 55 facing towards the covering plate 9 of the casing faces a corresponding surface 59 of the slider 4.

For the lever 55 acting on the inclined transverse face 53 of the stud 52 to remove the projecting member 11 from its position engaged with the edge surface 12 of the covering plate 9 the distance between the two surfaces 58 and 59 must be slightly greater than the height C of the area of contact between the edge surface 12 and the shoulder or edge surface 11*a* of the projecting member 11, for example equal to $C+\epsilon$, as shown diagrammatically in FIG. 11.

The lever 55 must also be able to move in the unlocking direction, i.e. in the direction opposite the locking direction 13, a sufficient distance, depending on the inclination of the inclined faces 53 and 54, to raise the stud 52, immobilized in the longitudinal direction, a distance at least equal to $C+\epsilon$.

Figure 13:
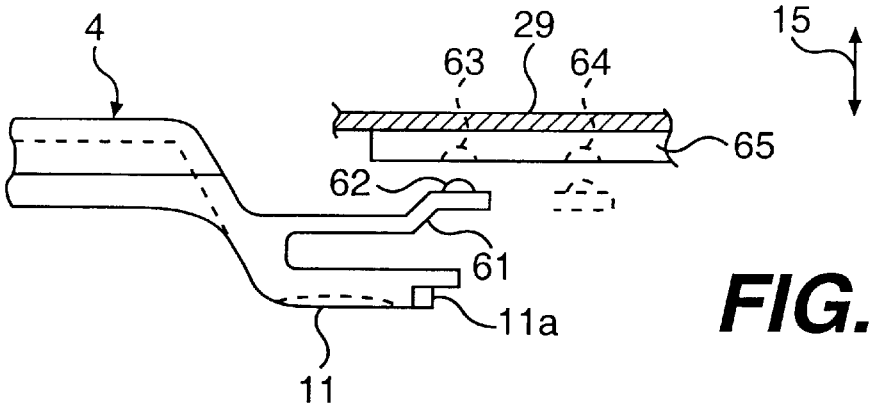
FIG. 13 is a view similar to FIG. 2 of a detail of another embodiment of the present invention.
Figure 14:
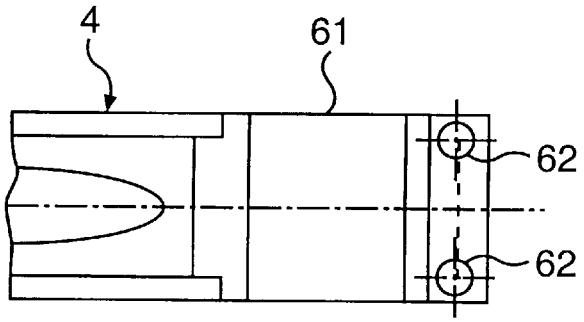
FIG. 14 is a top view of the detail shown in FIG. 13.

FIGS. 13 and 14 show another embodiment of means for spring return of the slider 4 towards the covering plate 9 of the casing 3 and for elastically opposing with a predetermined force of any movement of the slider 4 either way in the longitudinal direction from either of the locked and unlocked stable positions of the slider 4.

To this end the slider 4 has a lug 61 above the projecting member 11 extending in the longitudinal direction 5 of the casing opposite the locking direction 13.

The lug 61 has at least one shaped portion 62 at its free end adapted to engage elastically and respectively in the locked position and in the unlocked position of the slider 4 with complementary shaped portions 63 and 64 attached to or part of the rims 29 and 30 constituting the back of the casing 3.

In the example shown the lug 61 has two shaped portions 62 near respective lateral longitudinal walls 25 and 26 of the casing 3. Here the shaped portions 62 are substantially spherical convex excrescences.

In a complementary way, the rims 29 and 30 each have a shaped portion 63 and a shaped portion 64 which here are in the form of substantially spherical concave recesses.

The shaped portions 63 and 64 are obviously spaced from each other in the longitudinal direction 5 of the casing 3 by a distance corresponding to the travel of the slider 4 between its locked position shown in full line in FIG. 13 and its unlocked position shown in dashed line in the same figure. The shaped portions 63 and 64 are advantageously on arms 65 extending longitudinally under the rims 29 and 30 and fixed to the bottom of these rims in any manner.

The arms 65 can advantageously be part of a fixing member adapted to fix the corresponding end of the casing 3 to the corresponding end of the slot 16 in the wall 17 of the closure.

To make FIG. 13 clearer, the lug 61 is shown in FIG. 13 moved away from the arms 65 in the direction 15. It is clear that in reality the lug 61 bears elastically on these arms.

The slider 4 described hereinabove can advantageously be made by injection molding a heated plastics material. The lug 61 made in this way has sufficient spring return force to implement the functions described hereinabove.

The converse arrangement is obviously possible with convex excrescences on the rims 29 and 30 and complementary concave recesses on the lug 61.

Figure 5:
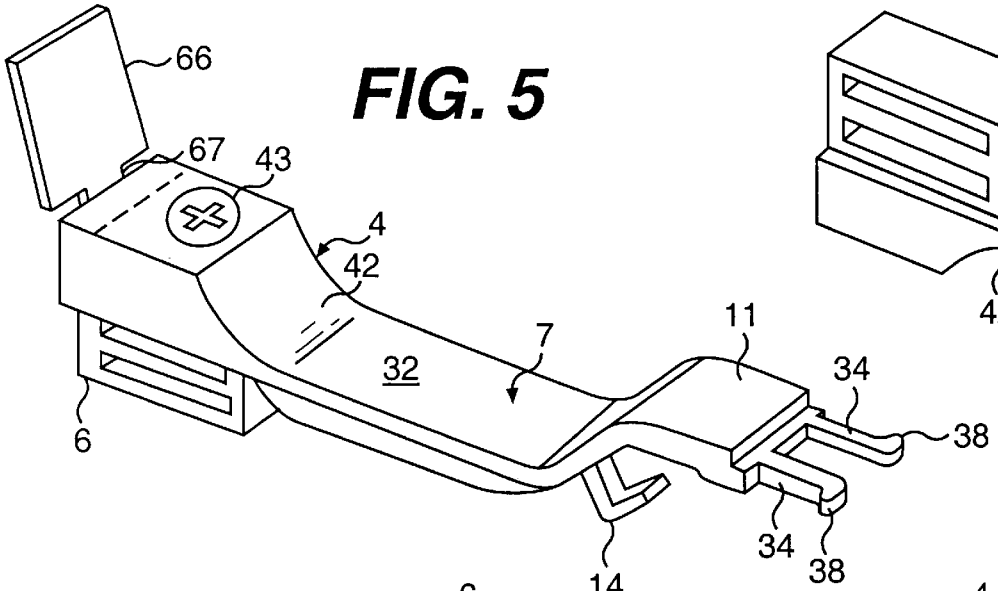
FIG. 5 is a perspective view of the slider of the embodiment from FIGS. 1 through 4 showing the slider with the maneuvering member directed towards the top of the figure and seen from the front as when installed on a sliding closure.

As shown in FIG. 5 the head of the screw 43 for immobilizing the bolt 40 can advantageously be concealed by a cover 66.

If the slider 4 is made from plastics material the cover 66 can advantageously be in one piece with the slider 4 to which it can be connected by a hinge 67 consisting of a thinner part of the plastics material. The cover 66 has a rectangular shape matching the rectangular shape of the slot 8 in the lock 1 shown in FIGS. 1 through 6.

Figure 15:
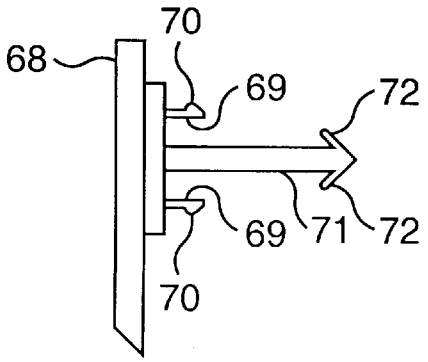
FIGS. 15 and 16 are respectively a profile view and a top view of a variant of the detail from FIG. 5.
Figure 16:
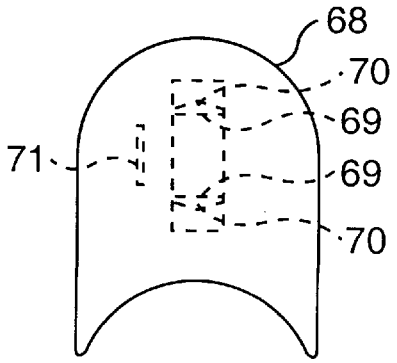

In the embodiment shown in FIGS. 15 and 16 the cover 68 has two parallel rounded transverse ends to suit a slot 8 with semicircular longitudinal ends.

The cover 68 has two claws 69 on its face facing towards the inside of the slider each having a lug 70 adapted to engage with complementary snaped portions, not shown, of the slider to fix the cover 68 removably to said slider 4.

In the example shown the cover 68 also has an elongate finger 71 carrying two tongues 72 at its free end forming an arrowhead adapted to be bent along the finger 71 to enter a complementary hole, not shown, in the slider 4 and to move away from the finger to retain the latter in the hole in order to retain the cover 68 to the slider when turning the screw 43.

FIG. 16 shows that the finger 71 is offset transversely relative to the claws 69, 70.

There has therefore been described a lock with a very simple and economic structure including a much smaller number of components than in the prior art. The lock is therefore particularly reliable whilst conforming to all the functional security criteria imposed on a lock of this kind, which is also compatible with the market requirements for the various aesthetic presentations to be offered to customers.

In the embodiment shown in FIGS. 17 through 23 the lock 101 for a sliding door, window or like closure 2 includes a sliding assembly 4 mobile in the longitudinal direction 5 of the casing 3 and carrying a bolt 40, a maneuvering member 7 for actuating the sliding assembly 4 from the inside wall 17 of the closure 2 and means for actuating the sliding assembly 4 from the covering plate 102 of the closure 2 by means of a lock cylinder 46 operated by a key 45.

The sliding assembly 4 shown in the figures is substantially identical to the slider 4 described with reference to FIGS. 1 through 16 but could be different from the latter. In particular, the sliding assembly 4 need not include the projecting member 11 adapted to immobilize the slider 4 in its locked position.

The bolt 40 can be of any type, carried by a bolt-carrier 6 of any type.

In the example shown the lock 101 includes a drive member 103 mobile in the longitudinal direction 5 of the casing 3 relative to said casing 3 and including means adapted to cooperate with complementary means attached to the cylinder 46 to enable said drive member 103 to be moved one way or the other in a direction 13 (the locking direction of the bolt) by means of the key 45 and means for cooperating with complementary means of the sliding assembly 4 to move said sliding assembly 4 one way or the other in the direction 13 by means of the key 45.

Figure 17:
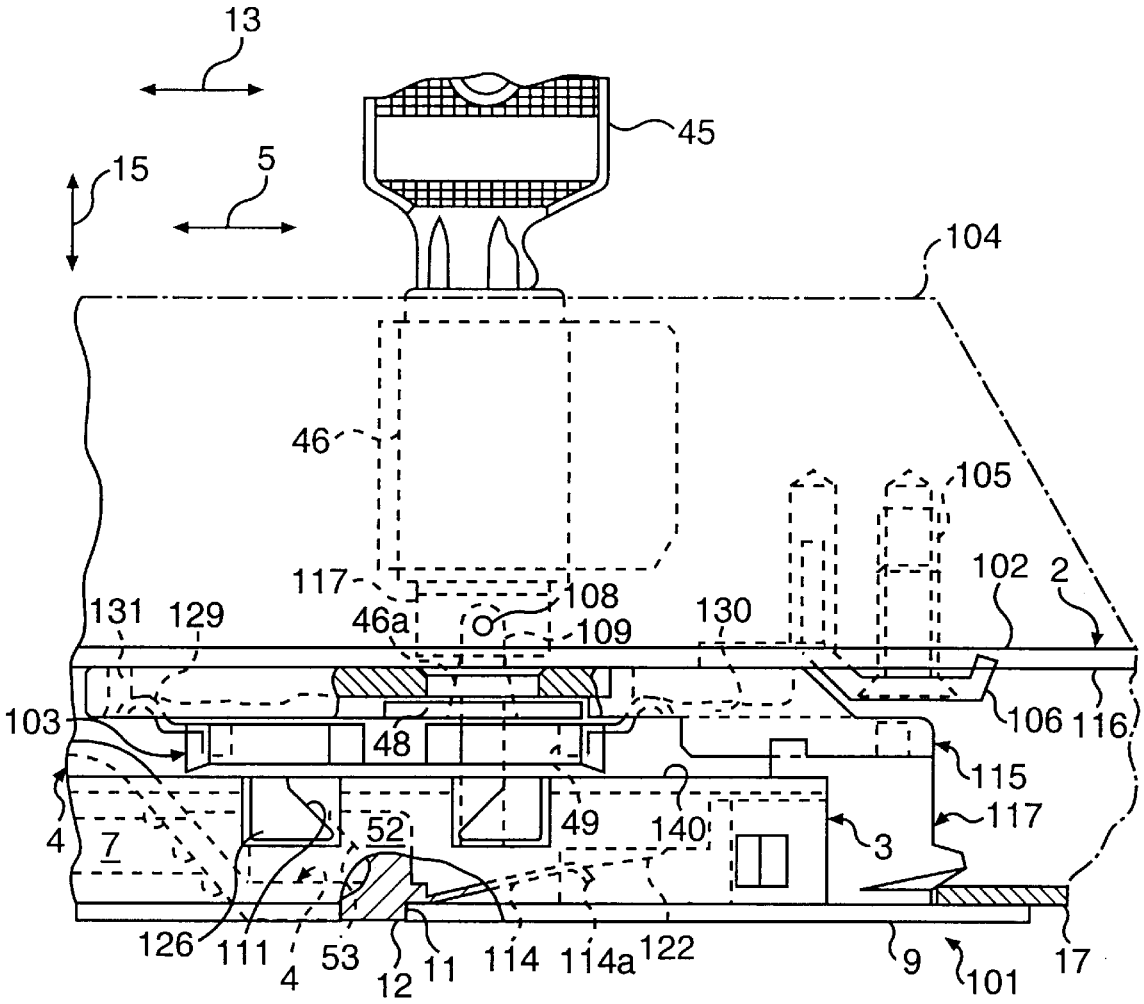
FIG. 17 is a fragmentary view to a larger scale similar to FIG. 2 of another embodiment of the lock of the present invention, the sliding assembly and the drive member being in the position corresponding to the locked position of the bolt.

In the example shown in FIG. 17 the cylinder 46 is inserted into the body of an external handle 104. The handle 104 is fixed to the wall 102 in a manner that is proof against tampering from the outside by fixing screws 105 by means of which the wall 102 is clamped between a fixing lug 106 and the handle 104.

A pivot pin 108 at the end 107 of the plug is used to attach a tongue 109 the function of which is described later.

The drive member 103 has on its face 110 facing the sliding assembly 4 shaped portions 111 (see FIG. 22), 112 (see FIG. 23) adapted to engage with complementary shaped portions 53, 113 of the sliding assembly.

Figure 18:
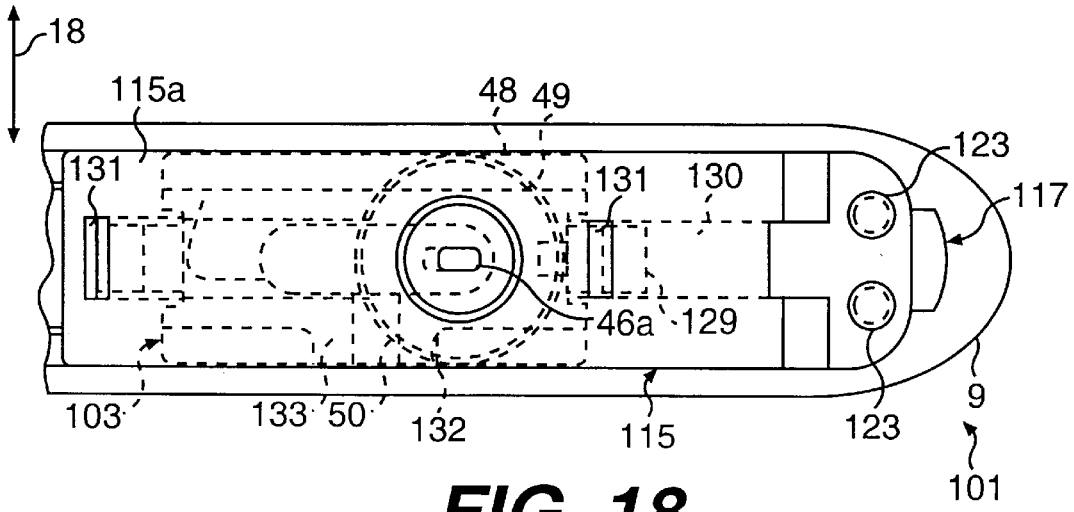
FIG. 18 is a top view of FIG. 17, showing the lock in isolation, removed from the closure, for clarity.

In the preferred embodiment shown the sliding assembly 4 has on its face 10 adjacent the covering plate 9 (or covering plate) of the casing 3 a member 11 projecting towards said covering plate 9 adapted to be clipped by spring means 114 against the edge surface 12 of a corresponding transverse edge of the slot 8 in the covering plate 9 in the locked position of the bolt shown in FIGS. 17 and 18.

As shown in FIGS. 17, 20, 21 and 22 in particular, the drive member 103 and the sliding assembly 4 include complementary means 53, 111 with conjugate shapes adapted to transform movement of the drive member 103 in the longitudinal direction 5 at the beginning of an unlocking operation into movement of the sliding assembly 4 towards the inside of said casing 3 in the direction 15 perpendicular to the covering plate 9 of the casing 3.

The sliding assembly 4 shown in the figures includes, as already described hereinabove, a stud 52 with an inclined transverse face 53.

The drive member 103 is a plate 103 (see FIGS. 22 and 23) adapted to slide along the outside edges 140 of the rims 29, 30 of the longitudinal lateral walls 25, 26 of the casing 3.

Figure 19:
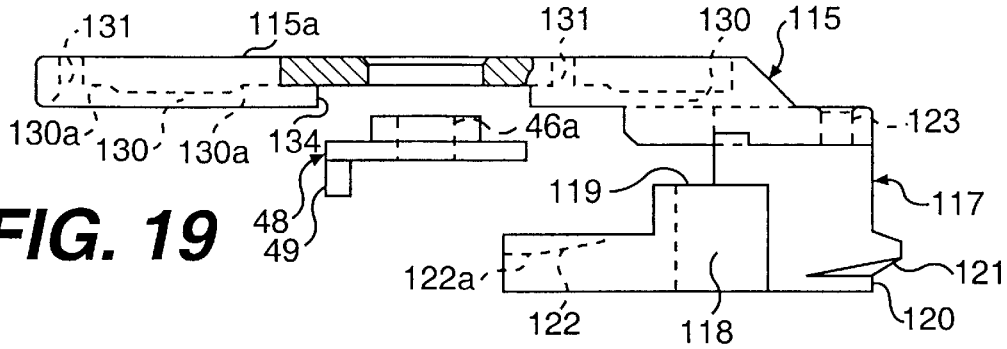
FIG. 19 is a view of a detail from FIG. 17 showing the extrusion fixing member and the guide member.

In this example the plate 103 is adapted to slide between the casing 3 and a guide member 115 shown in FIG. 19 in particular, attached to the casing 3 and extending along the inside face 116 of the wall 102, i.e. the face of the wall 102 facing the inside of the closure 2 (see FIG. 17).

The guide member 115 is fixed to a fixing member 117 including means for engaging with the casing 3 and with the slot 16 in the wall 17 on the inside of the closure 2 to clip the casing 3 to the wall 17 on the inside of the closure 2. A fixing member of this kind is described in French patent application FR-A-2761719 in the name of the applicant.

Figure 21:
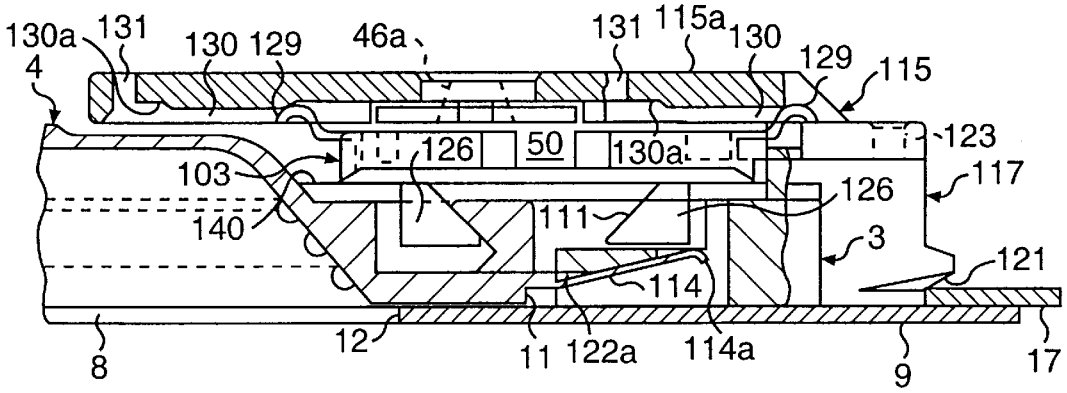
FIG. 21 is a partly cut away view similar to FIG. 20 showing how the drive member cooperates with the guide member and with the sliding assembly.

In order to engage with the casing 3 the fixing member 117 includes a central body 118 the cross-section of which substantially corresponds to the cross-section of the casing 3 and which is adapted to enter the casing 3 and the surface 119 of which bears on the bottom of the rims 29, 30 of the lateral longitudinal walls 25, 26 of the casing 3 (see FIGS. 19 and 21).

In order to engage with the slot 16 in the wall 17 of the closure 2 the fixing member 117 includes a re-entrant shoulder 120 associated with a ramp 121 which wedges the wall 17 between the ramp 121 and the covering plate 9 against the shoulder 120.

The figures show that the body 118 has a ramp 122 inside it adapted to cooperate with the elastic lug 114 of the sliding assembly 4.

Figure 20:
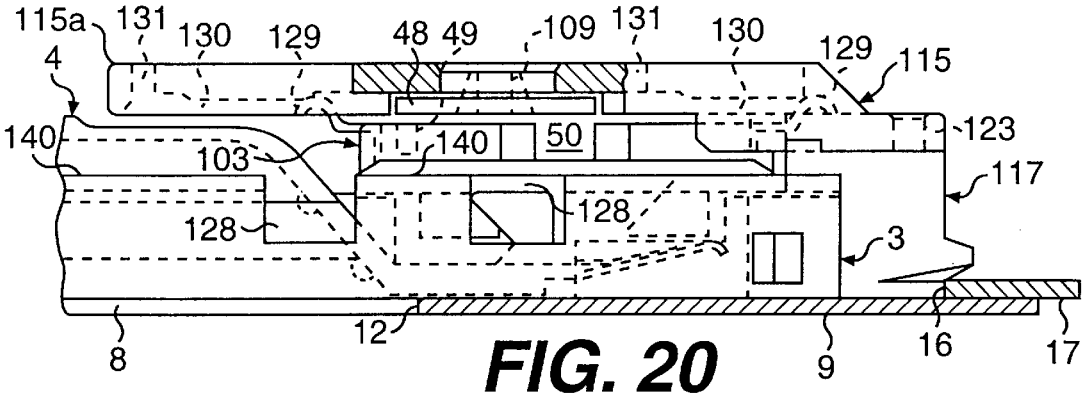
FIG. 20 is a view similar to FIG. 17 omitting the covering plate of the closure and showing the sliding assembly and the drive member in the position corresponding to the open position of the bolt.

In the open position of the bolt 40 and of the sliding assembly 4 shown in FIGS. 20 and 21 the end 114*a* of the elastic lug 114 is not loaded or is substantially not loaded by the ramp 122 and exerts substantially no load on the member 11 projecting towards the outside of the casing.

In the locked position of the bolt 40 shown in FIG. 17 the end 114*a* of the lug 114 has moved along the ramp 122 and rests on the flat 122*a* at the end of the ramp 122. The lug 114 therefore applies a maximal load to enable the projecting member 11 to be clipped to the edge surface 12 of the slot 8 in the covering plate 9.

The guide member 115 is fixed to the fixing member 117 by rivets shown diagrammatically at 123 in FIGS. 17 through 21, for example.

Figure 22:
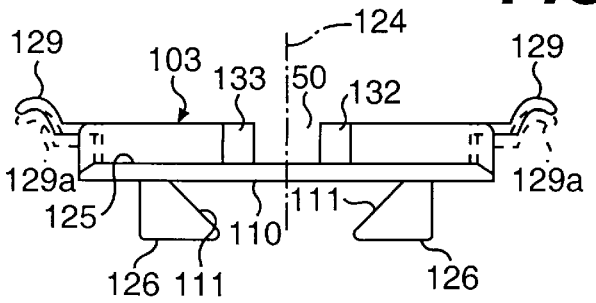
FIG. 22 is a view of a detail from FIGS. 17, 20 and 21 showing the drive member in elevation.
Figure 23:
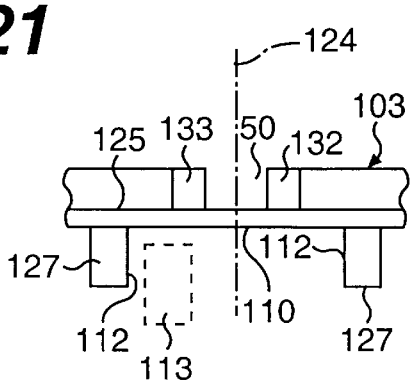
FIG. 23 is a fragmentary view similar to FIG. 22 of another embodiment of the drive member.

As shown in FIGS. 22 and 23 in particular, the plate 103 has on its face 110 adjacent the rims 29, 30 of the casing 3 at least one stud 126, 127 projecting towards the casing 3 for driving the sliding assembly 4.

In the example shown, the plate 103 is symmetrical about a transverse plane of symmetry 124 perpendicular to the longitudinal direction 5 of the casing 3.

In the example shown in FIG. 22, corresponding to a sliding member 4 including a projecting member 11, each stud 126 has an inclined face 111 corresponding to the aforementioned shaped portion 54 to cooperate with the shaped portion 53 of the stud 52 of the sliding assembly 4.

In the example shown in FIG. 23 each stud 127 has a face 112 parallel to the transverse plane of symmetry 124 because it is not necessary to transform slight longitudinal movement of the plate 103 in the longitudinal direction into movement of the sliding assembly 4 in the direction 15 at the beginning of an unlocking operation.

The symmetry of the plate 103 relative to the transverse plane 124 enables the plate 103 to be inserted between the guide member 115 and the casing 3 on site, the position of the plug 46 and that of the plate 103 being adjusted to suit the position of the closure relative to the frame.

The plate 103 is adapted to be inserted in the transverse direction 18 of the casing 3 between the guide member 115 and the casing 3 (see FIG. 18).

To this end, the longitudinal lateral walls 25, 26 include notches 128 for the studs 126, 127 to pass through.

The lock 101 includes clip means for holding the plate 103 in its operating position between the guide member 115 and the casing 3.

To this end the plate 103 has at each end in the longitudinal direction 5 of the casing at least one elastic lug 129 extending in said longitudinal direction 5 and towards the guide member 115.

The guide member 115 includes a groove 130 for each elastic lug 129 extending in the longitudinal direction 5 of the casing 3 and adapted to receive the corresponding elastic lug 129 to guide the plate 103 when it slides in the longitudinal direction 5 of the casing.

To enable the plate 103 to be inserted between the casing 3 and the guide member 115 the elastic lugs 129 can be bent towards the casing 3, into the position 129*a* shown in dashed line in FIG. 22.

To enable the plate 103 to be extracted from its operating position between the guide member 115 and the casing 3 the guide member 115 has two openings or slots 131 passing through it from the surface 115*a* of the member 115 adjacent the wall 102 in line with the positions occupied by the two lugs 129 in the position of the plate 103 corresponding to the locked position of the bolt and shown in FIGS. 17 and 18.

It is then sufficient to insert a pointed tool such as screwdriver blade into each opening 131 to depress the elastic lugs 129 and move them to the position 129*a* in which they are no longer engaged with the grooves 130, allowing the plate 103 to be extracted.

FIG. 21 shows that each groove 130 has a slight depression 130*a* at the position of the corresponding lug 129 when the plate 103 is in the position shown in FIGS. 17 and 18 corresponding to the locked position of the bolt. The depressions 130a define this position of the plate 103 with the necessary precision to ensure the projecting member 11 is clipped into the slot 8 when the bolt is to be locked by means of the key 45.

Similar shaped portions 130*a* are also provided for the positions of the lugs 129 on the plate 103 corresponding to the open position of the bolt.

The above remarks concerning the drive member 47 with reference to FIGS. 9 through 11 and 12A through 12D can be transposed to the plate 103.

Accordingly, the plate 103 has on its face 125 facing the guide member 115, on respective opposite sides of its transverse plane of symmetry 124, two ribs 132, 133 extending parallel to said plane 124 and to the transverse direction 18 of the lock 101, the facing faces of the ribs 132 and 133 forming the aforementioned walls 50*a*, 50*b*. Each rib 132, 133 is L-shape and includes a respective rib member 137, 138 extending in the longitudinal direction 5 and defining the respective aforementioned wall 80, 82.

The two ribs 132 and 133 are thus adapted to cooperate with the finger 49 attached to a disk 48 driven by the plug 46. The length and the separation of the two ribs 132, 133 are determined to allow the finger 49 to enter the housing 50 between the two ribs 132, 133 when the disk 48 turns one way or the other to press on the wall 50*a*, 50*b* of the second rib 132, 133 encountered and, through the intermediary of this second rib 132, 133, to push the plate 103 a predetermined distance the corresponding way in the longitudinal direction 5 to move the sliding assembly 4 from the locked position to the open position of the bolt 40, or vice versa, and then to allow the finger 49 to escape from said second rib 132, 133 encountered to allow completion of the rotation of the cylinder 46.

FIGS. 17 through 19 in particular show that the disk 48 is adapted to be received in the circular housing 134 in the guide member 115 facing the plate 103. The disk 48 has a flattened axial opening 46*a* into which the tongue 109 penetrates to enable actuation of the disk 48 by the cylinder 46.

The drive plate 103 therefore has an enantiomorphous structure symmetrical about the plane 124. This enables on-site choice of the direction of insertion of the plate 103 between the guide member 115 and the extrusion 3 according to the location of the cylinder 46 relative to the closure.

The plate 103 with two studs 126 enables the key 45 to be used from outside the closure 2 to move the sliding assembly in the locking direction 13 as far as its immobilized locked position (FIG. 17). The projecting member 11 is engaged with the edge surface 12 by the spring means 114.

The plate 103 also enables the key 45 to be used for movement in the opposite direction. In this case the surface 111 of the-stud 126 acting on the surface 53 of the stud 52 extracts the projecting member 11 from its position engaged with the edge surface 12 of the slot 8.

A lock 101 of simple modular construction has been described enabling on site choice of the functions required: locking by means of the key, dead locking by means of the key, automatic immobilization in the locked position, etc.

The guide member 115 of the plate 103 can therefore be fitted as required, in a position suited to the position of the cylinder 46 on the closure 2.

The components of the lock 101 can be adapted to suit all closure sizes, materials and specifications.

Of course, the present invention is not limited to the embodiments just described and many changes and modifications can be made to the latter without departing from the field of the invention.

For example, a slider in accordance with the invention can be fitted with a handle of any type other than that described hereinabove, for example a lever, rocker or plunger type handle passing through the slot 8.

Similarly, a slider and a casing can be provided respectively including the fingers 34 and the enlargements 36, or the lug 61 and the shaped portions 62, 63 and 64, with no projecting member 11 adapted to project through the slot 8 in the locked position of the slider 4.

The bolt-carrier 6 and the bolt 40 can be of any type.

The guide member 115 could be fixed to the casing 3 in some other way. The fixing of the guide member 115 to the fixing member 117 by rivets that are easy to install means that the guide member 115 need be used only if the lock allows the sliding assembly to be operated from outside the closure by means of the key 45.

There is claimed:

1. A lock assembly for a sliding closure having an inside wall and an outside wall, comprising:

an elongate casing having a covering plate and a pair of parallel lateral walls projecting from one face of the covering plate, the elongate casing being adapted for introduction in the closure through an elongate slot of the inside wall and the covering plate being adapted for closing a portion of said slot;

a sliding assembly disposed in the elongate casing for sliding movement in a longitudinal direction, said sliding assembly comprising a bolt carrier carrying a bolt and a maneuvering member for actuating the sliding assembly through the elongate slot of the inside wall; and a lock for actuating the sliding assembly through an opening of the outside wall, said lock comprising:

a key operated lock cylinder with first complementary means attached thereto;

a drive member movable longitudinally disposed adjacent to the sliding assembly;

first actuating means adapted to cooperate with the first complementary means to move the drive member longitudinally responsive to key operation;

second actuating means attached to the drive member adapted to cooperate with second complementary means attached to the sliding assembly to longitudinally move the sliding assembly, wherein said drive member is a drive plate mounted parallel to said covering plate slidable between the elongate casing and a guide member fixed to the elongate casing, and wherein the first actuating means protrude from a face of the drive plate facing the guide member and the second actuating means protrude from another face of the drive plate.

2. The lock assembly claimed in claim 1 wherein said drive member comprises a face facing said sliding assembly and shaped portions extending from said face adapted to engage complementary shaped portions of said sliding assembly.

3. The lock assembly claimed in claim 2 wherein said sliding assembly includes on its face adjacent to the covering plate of said casing a member projecting towards said covering plate adapted to be clipped by spring means against the edge surface of a corresponding transverse edge of a slot in said covering plate in the locked position of said bolt, and said drive member and said sliding assembly include complementary means of conjugate shape adapted to transform movement of said drive member in said longitudinal direction at the start of an unlocking operation into movement of said sliding assembly towards the inside of said casing in the direction perpendicular to said covering plate of said casing.

4. The lock assembly claimed in claim 3 wherein said sliding assembly includes a stud having a transverse face facing in a locking direction of said sliding assembly that is inclined relative to said perpendicular direction and extends in said locking direction and towards the inside of said casing, and wherein said drive member has a complementary face inclined substantially in the same direction so as to move said sliding assembly in the direction towards the inside of said casing at the beginning of an operation to unlock said sliding assembly by means of said key.

5. The lock assembly claimed in claim 1 wherein said drive member is a plate adapted to slide along external edges of rims of the parallel lateral walls of said casing.

6. The lock assembly claimed in claim 5 wherein said plate is adapted to slide between said casing and the guide member, said guide member being attached to said casing and extending along the inside face of said wall on the outside of said closure.

7. The lock assembly claimed in claim 6 wherein said guide member is fixed to a fixing member including means for engaging with said casing and with said elongate slot in said inside wall to clip said casing to said inside wall.

8. The lock assembly claimed in claim 6 wherein said plate has on its face adjacent said casing at least one stud projecting towards said casing for driving said sliding assembly.

9. The lock assembly claimed in claim 5 wherein said plate is symmetrical relative to a transverse plane of symmetry perpendicular to said longitudinal direction of said casing.

10. The lock assembly claimed in claim 8 wherein said plate is symmetrical relative to a transverse plane of symmetry perpendicular to said longitudinal direction, and is adapted to be inserted in said transverse direction of said casing between said casing and said guide member, and wherein said pair of parallel lateral walls of said casing include notches for said studs to pass through and said lock includes clip means for retaining said plate in an operating position between said guide member and said casing.

11. The lock assembly claimed in claim 10 wherein said plate has at each end in said longitudinal direction of said casing at least one elastic lug extending in said longitudinal direction and towards said guide member, and wherein said guide member has, for each elastic lug, a groove extending in said longitudinal direction of said casing adapted to receive the corresponding elastic lug to guide said plate when it slides in said longitudinal direction of said casing.

12. The lock assembly claimed in claim 8 wherein said plate has on its face facing said guide member, on either side of its transverse plane of symmetry, two ribs extending parallel to said plane and adapted to cooperate with a finger attached to a disk driven by said cylinder and the length and the separation of said two ribs being such as to enable said finger to enter a housing formed between said two ribs when said disk turns in one direction or the other to press on a wall of the second rib encountered and, through the intermediary of said second rib, to push said plate a predetermined distance the corresponding way in said longitudinal direction to move said sliding assembly from a locked position to an open position of said bolt, or vice versa, and then to enable said finger to escape from said second rib encountered to allow completion of rotation of said cylinder.

* * * * *